US006516881B2

(12) United States Patent
Hailey, Jr.

(10) Patent No.: US 6,516,881 B2
(45) Date of Patent: Feb. 11, 2003

(54) APPARATUS AND METHOD FOR GRAVEL PACKING AN INTERVAL OF A WELLBORE

(75) Inventor: Travis T. Hailey, Jr., Sugar Land, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 22 days.

(21) Appl. No.: 09/893,761

(22) Filed: Jun. 27, 2001

(65) Prior Publication Data

US 2003/0000699 A1 Jan. 2, 2003

(51) Int. Cl.[7] ..... E21B 43/04; E21B 43/08

(52) U.S. Cl. ..... 166/278; 166/51; 166/236; 166/233; 166/227

(58) Field of Search ..... 166/278, 51, 233, 166/236, 227

(56) References Cited

U.S. PATENT DOCUMENTS

| | | | | |
|---|---|---|---|---|
| 2,342,913 | A | 2/1944 | Williams et al. | |
| 2,344,909 | A | 3/1944 | Williams et al. | |
| 4,945,991 | A | 8/1990 | Jones | 166/278 |
| 5,082,052 | A | 1/1992 | Jones et al. | 166/51 |
| 5,113,935 | A | 5/1992 | Jones et al. | 166/51 |
| 5,161,613 | A | 11/1992 | Jones | 166/242 |
| 5,161,618 | A | 11/1992 | Jones et al. | 166/308 |
| 5,333,688 | A | 8/1994 | Jones et al. | 166/278 |
| 5,355,956 | A | 10/1994 | Restarick | 166/296 |
| 5,390,966 | A | 2/1995 | Cox et al. | 285/137.1 |

(List continued on next page.)

FOREIGN PATENT DOCUMENTS

| | | | |
|---|---|---|---|
| EP | 1 132 571 | 9/2001 | E21B/43/267 |
| WO | WO 99/12630 | 3/1999 | B01D/29/15 |
| WO | WO 00/61913 | 10/2000 | E21B/43/04 |
| WO | WO 01/14691 | 3/2001 | E21B/43/08 |
| WO | WO 01/44619 | 6/2001 | E21B/43/04 |
| WO | WO 02/10554 | 2/2002 | E21B/43/26 |

OTHER PUBLICATIONS

"Frac Pack Technology Still Evolving," Charles D. Ebinger of Ely & Associates Inc.; Oil & Gas Journal, Oct. 23, 1995.

"Mechanical Fluid–Loss Control Systems Used During Sand Control Operations," H.L. Restarick of Otis Engineering Corp., 1992.

"Sand Control Screens," Halliburton Energy Services, 1994.

"Screenless Single Trip Multizone Sand Control Tool System Saves Rig Time," Travis Hailey and Morris Cox of Haliburton Energy Services, Inc.; and Kirk Johnson of BP Exploration (Alaska), Inc. Society of Petroleum Engineers Inc., Feb., 2000.

(List continued on next page.)

*Primary Examiner*—David Bagnell
*Assistant Examiner*—Robert D Jones
(74) *Attorney, Agent, or Firm*—Paul I. Herman; Lawrence R. Youst

(57) ABSTRACT

An apparatus (60) and method for gravel packing an interval of a wellbore is disclosed. The apparatus (60) comprises a sand control screen (78) that is positioned within the wellbore and a tube and manifold system (62) positioned between the sand control screen (78) and the wellbore. The tube and manifold system (62) delivers a fluid slurry to a plurality of levels within the interval when the apparatus (60) is in an operable position. The tubes (64, 70, 76) of the tube and manifold system (62) have first and second ends which are open such that the fluid slurry may enter one end, travel through the entire length of the tube (64, 70, 76) and exit the other end. The manifolds (66, 72) of the tube and manifold system (62) each have at least one exit port (68, 74) for the discharge of the fluid slurry from the tube and manifold system (62).

49 Claims, 7 Drawing Sheets

U.S. PATENT DOCUMENTS

| | | | | | |
|---|---|---|---|---|---|
| 5,419,394 | A | | 5/1995 | Jones | 166/51 |
| 5,443,117 | A | | 8/1995 | Ross | 166/51 |
| 5,476,143 | A | | 12/1995 | Sparlin et al. | 166/233 |
| 5,515,915 | A | | 5/1996 | Jones et al. | 166/51 |
| 5,588,487 | A | | 12/1996 | Bryant | 166/51 |
| 5,636,691 | A | | 6/1997 | Hendrickson et al. | 166/278 |
| 5,755,286 | A | | 5/1998 | Ebinger | 166/281 |
| 5,842,516 | A | | 12/1998 | Jones | 166/56 |
| 5,848,645 | A | | 12/1998 | Jones | 166/280 |
| 5,868,200 | A | | 2/1999 | Bryant et al. | 166/51 |
| 5,890,533 | A | | 4/1999 | Jones | 166/51 |
| 5,921,318 | A | | 7/1999 | Ross | 166/250.17 |
| 5,931,229 | A | * | 8/1999 | Lehr et al. | 166/278 |
| 5,934,376 | A | | 8/1999 | Nguyen et al. | 166/278 |
| 6,003,600 | A | | 12/1999 | Nguyen et al. | 166/281 |
| 6,047,773 | A | | 4/2000 | Zeltmann et al. | 166/281 |
| 6,059,032 | A | | 5/2000 | Jones | 166/278 |
| 6,116,343 | A | | 9/2000 | Van Petegem et al. | 166/297 |
| 6,125,933 | A | | 10/2000 | Ross | 166/250.01 |
| 6,220,345 | B1 | | 4/2001 | Jones et al. | 166/51 |
| 6,227,303 | B1 | | 5/2001 | Jones | 166/378 |
| 6,230,803 | B1 | | 5/2001 | Morton et al. | 166/278 |
| 6,298,916 | B1 | * | 10/2001 | Tibbles et al. | 166/145 |
| 6,343,651 | B1 | | 2/2002 | Bixenman | 166/278 |

OTHER PUBLICATIONS

"Simultaneous Gravel Packing and Filter Cake Removal in Horizontal Wells Applying Shunt Tubes and Bovel Carrier and Breaker Fluid," Pedro M. Saldungaray of Schlumberger; Juan C. Troncoso of Repson–YPF; Bambang T. Santoso of Repsol–YPF. Society of Petroleum Engineers, Inc., Mar., 2001.

"CAPS$^{SM}$ Concentric Annular Packing Service for Sand Control," Halliburton Energy Services, Inc., Aug., 2000.

"CAPS$^{SM}$ Sand Control Service for Horizontal Completions Improves Gravel Pack Reliability and Increases Production Potential from Horizontal Completions," Halliburton Energy Services, Inc., Aug., 2000.

* cited by examiner

APPARATUS AND METHOD FOR GRAVEL PACKING AN INTERVAL OF A WELLBORE

TECHNICAL FIELD OF THE INVENTION

This invention relates in general to preventing the production of particulate materials through a wellbore traversing an unconsolidated or loosely consolidated subterranean formation and, in particular, to an apparatus and method for obtaining a substantially complete gravel pack within an interval of the wellbore.

BACKGROUND OF THE INVENTION

Without limiting the scope of the present invention, its background is described with reference to the production of hydrocarbon fluids through a wellbore traversing an unconsolidated or loosely consolidated formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate. For example, the particulate cause abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent to the unconsolidated or loosely consolidated production interval. In a typical gravel pack completion, a sand control screen is lowered into the wellbore on a work string to a position proximate the desired production interval. A fluid slurry including a liquid carrier and a particulate material known as gravel is then pumped down the work string and into the well annulus formed between the sand control screen and the perforated well casing or open hole production zone.

The liquid carrier either flows into the formation or returns to the surface by flowing through the sand control screen or both. In either case, the gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in long or inclined/horizontal production intervals. These incomplete packs are commonly a result of the liquid carrier entering a permeable portion of the production interval causing the gravel to form a sand bridge in the annulus. Thereafter, the sand bridge prevents the slurry from flowing to the remainder of the annulus which, in turn, prevents the placement of sufficient gravel in the remainder of the annulus.

Prior art devices and methods have been developed which attempt to overcome this sand bridge problem. For example, attempts have been made to use devices having perforated shunt tubes or bypass conduits that extend along the length of the sand control screen to provide an alternate path for the fluid slurry around the sand bridge.

It has been found, however, that shunt tubes installed on the exterior of sand control screens are susceptible to damage during installation and may fail during a gravel packing operation due, in part, to the perforations through the side wall of the shunt tubes. In addition, it has been found, that on site assembly of a shunt tube system around a sand control screen is difficult and time consuming due to the large number of fluid connections required for typical production intervals.

Therefore a need has arisen for an apparatus and method for gravel packing a production interval traversed by a wellbore that overcomes the problems created by sand bridges. A need has also arisen for such an apparatus that is not susceptible to damage during installation and will not fail during a gravel packing operation. Further, a need has arisen for such an apparatus that is cost effective and does not require difficult or time consuming on site assembly.

SUMMARY OF THE INVENTION

The present invention disclosed herein comprises an apparatus and method for gravel packing a production interval of a wellbore that traverses an unconsolidated or loosely consolidated formation that overcomes the problems created by the development of a sand bridge between a sand control screen and the wellbore. Importantly, the apparatus of the present invention is not susceptible to damage during installation or failure during the gravel packing operation, is cost effective to manufacture and does not require difficult or time consuming on site assembly.

The apparatus comprises a sand control screen that is positioned within the wellbore and a tube and manifold system that is positioned between the sand control screen and the wellbore. The tube and manifold system may be constructed in sections that are integral with each section of the sand control screen such that sections of the apparatus are simply threaded together in a known manner prior to running it downhole. Alternatively, the tube and manifold system may be run downhole and positioned proximate the formation prior to running the sand control screen downhole. In this case, when the sand control screen is run downhole, it is positioned within the tube and manifold system.

In either case, the tube and manifold system is used to selectively deliver the fluid slurry to a plurality of levels within the interval when the apparatus is in the operable position. The tube and manifold system comprises, in series, one or more tubes then a manifold followed by one or more tubes then another manifold and so forth. The tubes of the tube and manifold system have first and second ends which are open but do not have openings in their side walls as the fluid slurry is discharged from the tube and manifold system only through exit ports in the manifolds.

In most embodiments of the present invention, the exit ports of the manifolds are circumferentially misaligned with the adjacent tubes of the tube and manifold system. In other embodiment, however, some or all of the exit ports of the manifolds may be circumferentially aligned with the adjacent tubes of the tube and manifold system. There may be the same number, more or less exit ports in each manifold than the number of tubes delivering the fluid slurry to that manifold.

In one embodiment of the present invention, each section of the sand control screen has a plurality of manifolds positioned adjacently thereto. The tubes that deliver the fluid slurry to and transport the fluid slurry from these intrasectional manifolds are axially aligned with one another. In addition to these intrasectional manifolds, there is one manifold positioned between adjacent sections of the sand control screen. The tubes that deliver the fluid slurry to and transport the fluid slurry from these intersectional manifolds are typically axially misaligned with one another.

One method of the present invention involves traversing a formation with the wellbore, positioning a tube and manifold system within the wellbore proximate the formation, locating a sand control screen within the tube and manifold system, injecting a fluid slurry containing gravel through the tube and manifold system such that the fluid slurry exits the tube and manifold system through the exit ports in the manifolds at a plurality of levels of the interval and terminating the injecting when the interval is substantially completely packed with the gravel.

Another method of the present invention involves traversing a formation with the wellbore, positioning a tube and manifold system around a sand control screen, locating the sand control screen and the tube and manifold system within the wellbore proximate the formation, injecting a fluid slurry containing gravel through the tube and manifold system such that the fluid slurry exits the tube and manifold system through the exit ports in the manifolds at a plurality of levels of the interval and terminating the injecting when the interval is substantially completely packed with the gravel.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
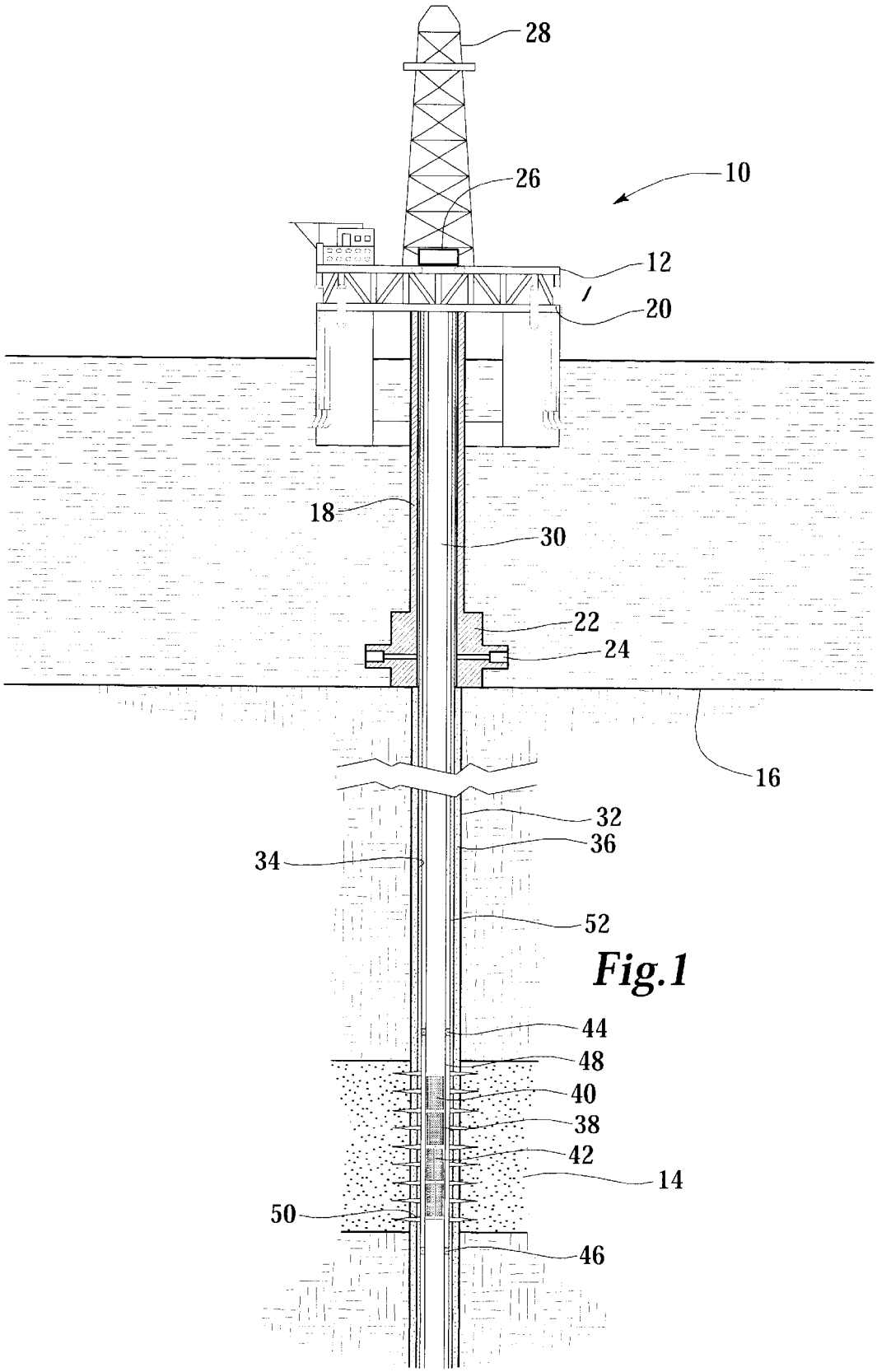
FIG. 1 is a schematic illustration of an offshore oil and gas platform operating an apparatus for gravel packing an interval of a wellbore of the present invention.

Referring initially to FIG. 1, an apparatus for gravel packing an interval of a wellbore operating from an offshore oil and gas platform are schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 includes various tools for completing the well. On the lower end of work string 30 is an apparatus 38 for gravel packing an interval of wellbore 32 including sand control screen assembly 40 as well as tube and manifold system 42. Apparatus 38 is positioned adjacent to formation 14 between packers 44, 46 in annular region or interval 48 including perforations 50. When it is desired to gravel pack annular interval 48, a fluid slurry including a liquid carrier and a particulate material such as gravel is pumped down work string 30.

As explained in more detail below, the fluid slurry will generally be injected into annular interval 48 between apparatus 38 and wellbore 32 in a known manner such as through a crossover tool (not pictured) which allows the slurry to travel from the interior of work string 30 to the exterior of work string 30. Once the fluid slurry is in annular interval 48, a portion of the gravel in the fluid slurry is deposited in annular interval 48. Some of the liquid carrier may enter formation 14 through perforation 50 while the remainder of the fluid carrier entering sand control screen assembly 40. More specifically, sand control screen assembly 40 disallows further migration of the gravel in the fluid slurry but allows the liquid carrier to travel therethrough and up to the surface in a known manner, such as through a wash pipe and into the annulus 52 above packer 44. If a sand bridge forms during the injection of the fluid slurry into annular region 48, the fluid slurry will be diverted into tube and manifold system 42 of apparatus 38 to bypass this sand bridge. In this case, the fluid slurry will exit tube and manifold system 42 through the manifolds at various levels within interval 48. Again, once in annular interval 48, the gravel in the fluid slurry is deposited therein. Some of the liquid carrier may enter formation 14 through perforation 50 while the remainder of the fluid carrier enters sand control screen assembly 40, as described above, and returns to the surface. The operator continues to pump the fluid slurry down work string 30 into annular interval 48 and through tube and manifold system 42, as necessary, until annular interval 48 surrounding sand control screen assembly 40 is filled with gravel, thereby achieving a complete pack of interval 48. Alternatively, it should be noted by those skilled in the art, that the fluid slurry may be injected entirely into tube and manifold system 42 of apparatus 38 without first injecting the fluid slurry directly into annular interval 48.

Even though FIG. 1 depicts a vertical well, it should be noted by one skilled in the art that the apparatus for gravel packing an interval of a wellbore of the present invention is equally well-suited for use in deviated wells, inclined wells or horizontal wells. In addition, it should be apparent to those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Also, even though FIG. 1 depicts an offshore operation, it should be noted by one skilled in the art that the apparatus for gravel packing an interval of a wellbore of the present invention is equally well-suited for use in onshore operations. Further, even though FIG. 1 has been described with regard to a gravel packing operation, it should be noted by one skilled in the art that the apparatus of the present invention is equally well-suited for fracture operations and frac pack operations wherein a fluid slurry containing propping agents is delivered at a high flow rate and at a pressure above the fracture pressure of formation 14 such that fractures may be formed within formation 14 and held open by the propping agents and such that annular interval 48 is packed with the propping agents or other suitable particulate materials to prevent the production of fines from formation 14.

Figure 2:
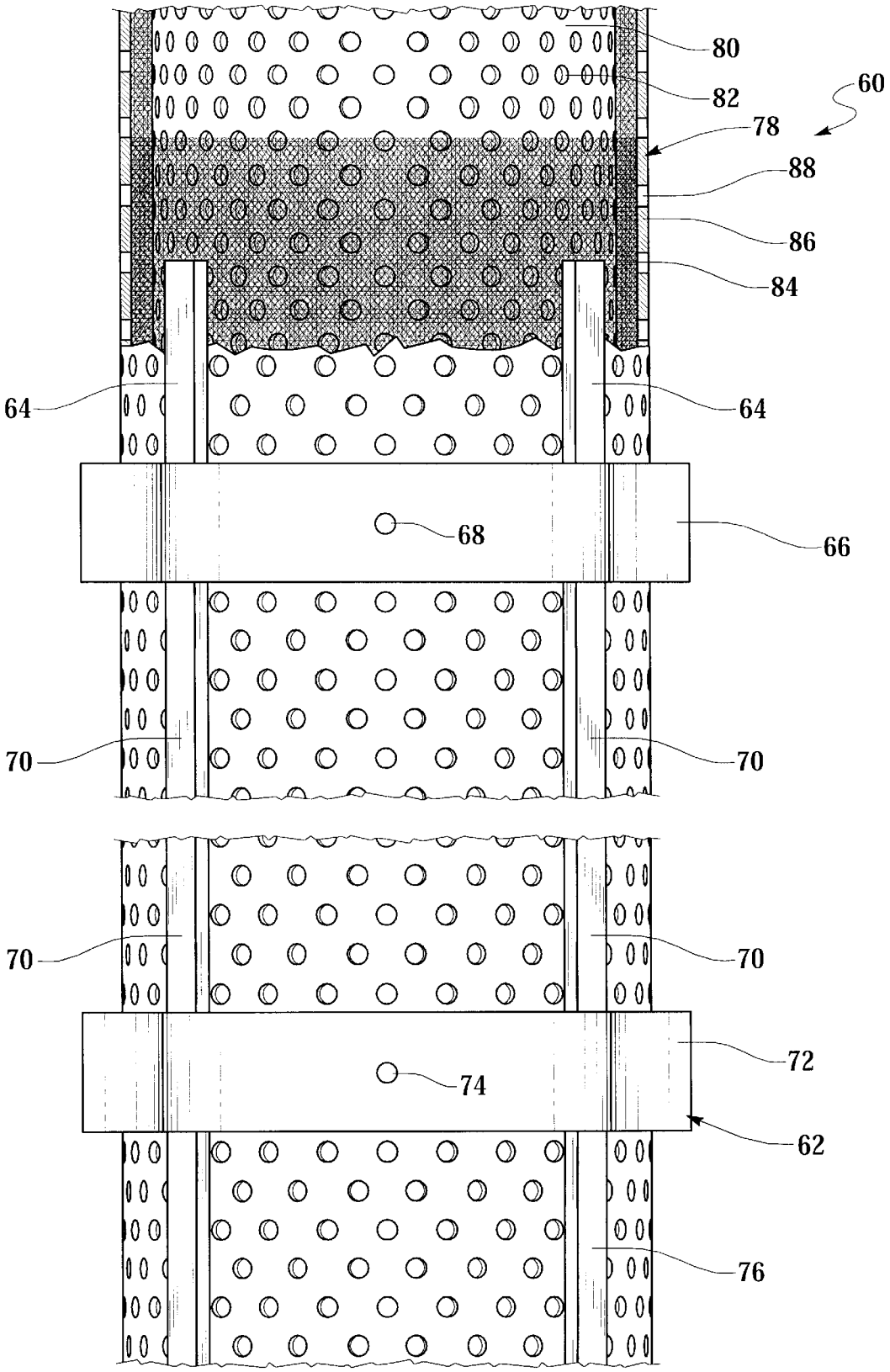
FIG. 2 is partial cut away view of an apparatus for gravel packing an interval of a wellbore of the present invention.

Referring now to FIG. 2, therein is depicted a partial cut away view of an apparatus for gravel packing an interval of a wellbore of the present invention that is generally designated 60. Apparatus 60 includes a tube and manifold system 62 that has four tubes extending between each manifold. Specifically, four tubes 64, only two of which are pictured, deliver the fluid slurry to manifold 66. A portion of the fluid slurry in manifold 66 will enter the annular interval surrounding apparatus 60 via two exit ports 68, only one of which is shown. The remainder of the fluid slurry enters four tubes 70, only two of which are pictured, and is delivered to manifold 72. Again, a portion of the fluid slurry in manifold 72 will enter the annular interval surrounding apparatus 60 via two exit ports 74, only one of which is shown. The remainder of the fluid slurry enters four tubes 76, only two of which are pictured, and is delivered to the next manifold of tube and manifold system 62. This process continues through the various levels of the tube and manifold system 62 along the entire length of the interval to be gravel packed such that a complete gravel pack of the interval can be achieved.

Importantly, the tubes of tube and manifold system 62 do not have openings or perforations in the side walls thereof for the discharge of the fluid slurry into the annular interval surrounding apparatus 60. It has been found that fluid delivery tubes, such as shunt tubes or conduits that have openings or perforations in their side walls are susceptible to damage during installation and failure during use due to their lack of strength. In fact, use of the non perforated tubes of the present invention allows for the delivery of a greater volume of fluid at a higher flowrate, making frac packing a possibility. In addition, having the exit ports in the manifolds instead of in the tubes allows for the use of nozzles in the exit ports which improve the overall delivery of the fluid slurry from tube and manifold system 62.

Another important feature of this embodiment of the present invention is that the exit ports of the manifolds are not circumferentially aligned with the tubes of tube and manifold system 62. This feature helps to minimize liquid leak off after the area adjacent to a particular manifold has been packed with the gravel. Specifically, even after an area surrounding one of the manifolds has been packed with the gravel, it has been found that liquid from the fluid slurry may nonetheless leak off into this porous region causing not only a reduction in the velocity of the fluid slurry in tube and manifold system 62, but also, an increase in the effective density of particles in the fluid slurry, each of which is a hindrance to particle transport to locations further along tube and manifold system 62. Positioning the exit ports out of phase with the tubes reduces the liquid leak off by increasing the pressure required to push the liquid through the porous matrix and reduces the velocity of the liquid near the exit ports, thereby reducing the rate of liquid leak off. This rate of liquid leak off is further reduced by using a liquid in the fluid slurry that is thixotropic such that its viscosity increases with reduced velocity through the porous matrix.

Even though FIG. 2 has depicted exit ports 68, 74 as being circular, it should be understood by those skilled in the art that exit ports 68, 74 could alternatively have other shapes without departing from the principles of the present invention, those shapes being considered within the scope of the present invention. Also, it should be noted by those skilled in the art that even though FIG. 2 has depicted tubes 64, 70, 76 as having a rectangular cross section, tubes having other cross sectional configurations may alternatively be used without departing from the principles of the present invention and are considered within the scope of the present invention.

Disposed within tube and manifold system 62 is a sand control screen assembly 78. Sand control screen assembly 78 includes a base pipe 80 that has a plurality of openings 82 which allow the flow of production fluids into the production tubing. The exact number, size and shape of openings 82 are not critical to the present invention, so long as sufficient area is provided for fluid production and the integrity of base pipe 80 is maintained. Positioned around base pipe 80 is a fluid-porous, particulate restricting, sintered metal material such as a plurality of layers of a wire mesh that are sintered together to form a porous sintered wire mesh screen 84. Screen 84 is designed to allow fluid flow therethrough but prevent the flow of particulate materials of a predetermined size from passing therethrough. Positioned around screen 84 is a screen housing 86 that has a plurality of openings 88 which allow the flow of production fluids therethrough. The exact number, size and shape of openings 88 is not critical to the present invention, so long as sufficient area is provided for fluid production and the integrity of housing 86 is maintained.

Figure 3:
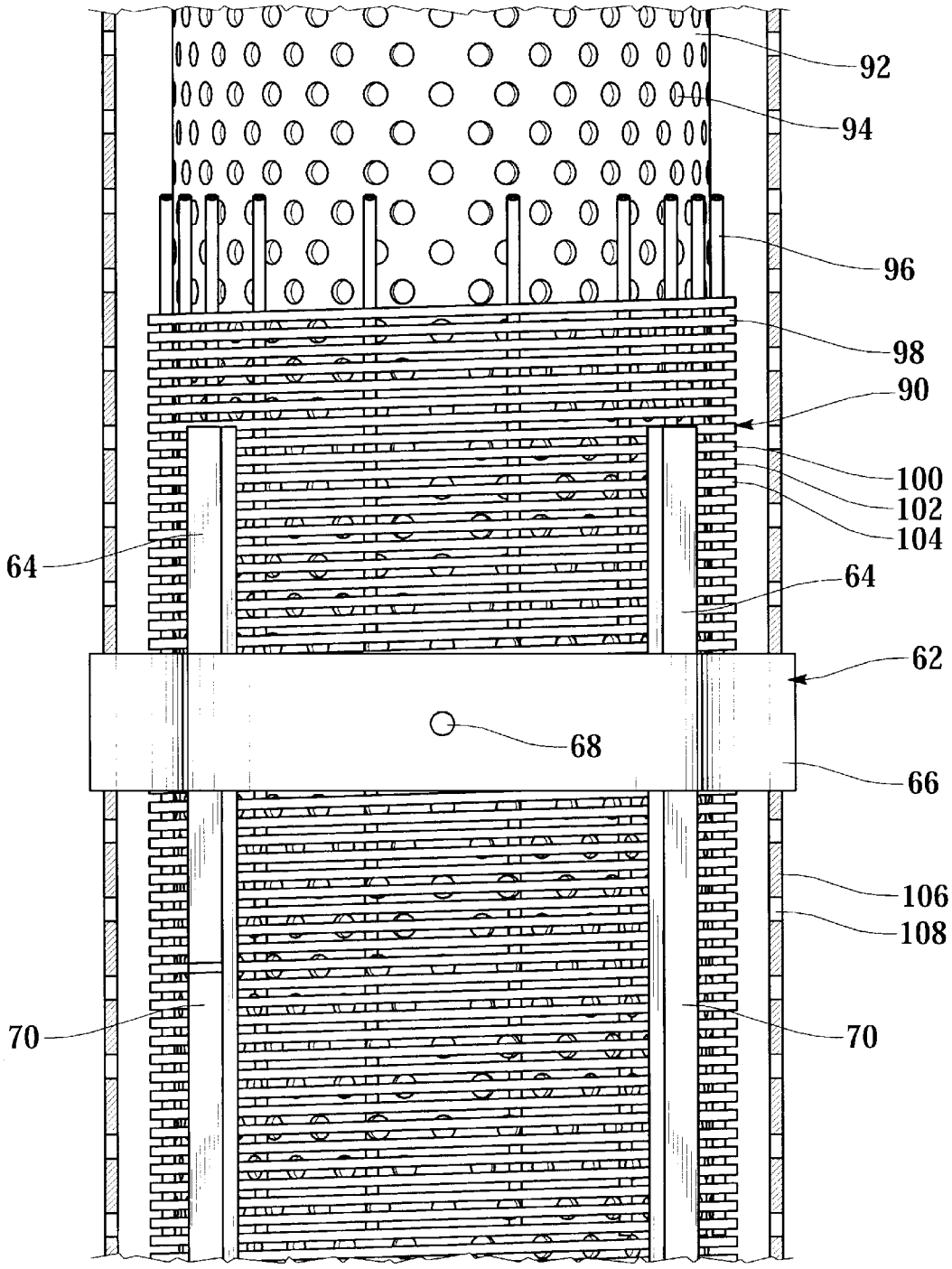
FIG. 3 is partial cut away view of an apparatus for gravel packing an interval of a wellbore of the present invention.

It should be understood by those skilled in the art that other types of filter media may be used in conjunction with tube and manifold system 62. For example, as seen in FIG. 3, a wire wrap screen assembly 90 may alternately be used. Screen assembly 90 has a base pipe 92 that has a plurality of openings 94. A plurality of ribs 96 are spaced around base pipe 92. Ribs 96 are generally symmetrically distributed about the axis of base pipe 92. Ribs 96 are depicted as having a cylindrical cross section, however, it should be understood by one skilled in the art that ribs 96 may alternatively have a rectangular or triangular cross section or other suitable geometry. Additionally, it should be understood by one skilled in the art that the exact number of ribs 96 will be dependent upon the diameter of base pipe 92 as well as other design characteristics that are well known in the art.

Wrapped around ribs 96 is a screen wire 98. Screen wire 98 forms a plurality of turns, such as turn 100, turn 102 and turn 104. Between each of the turns is a gap through which formation fluids flow. The number of turns and the gap between the turns are determined based upon factors such as the characteristics of the formation from which fluid is being produced and the size of the gravel to be used during the gravel packing operation. Together, ribs 96 and screen wire 98 may form a sand control screen jacket which is attached to base pipe 92 by welding or other suitable technique.

In this embodiment, an outer shroud 106 having a plurality of perforations 108 is disposed around the tubes of tube and manifold system 62. Outer shroud 106 provides protection to tubes 64, 70 during, for example, installation of tube and manifold system 62 in an uncased well. Alternatively, it should be noted by those skilled in the art, that a shroud could be placed around both the tubes and the manifolds of tube and manifold system 62.

Figure 4:
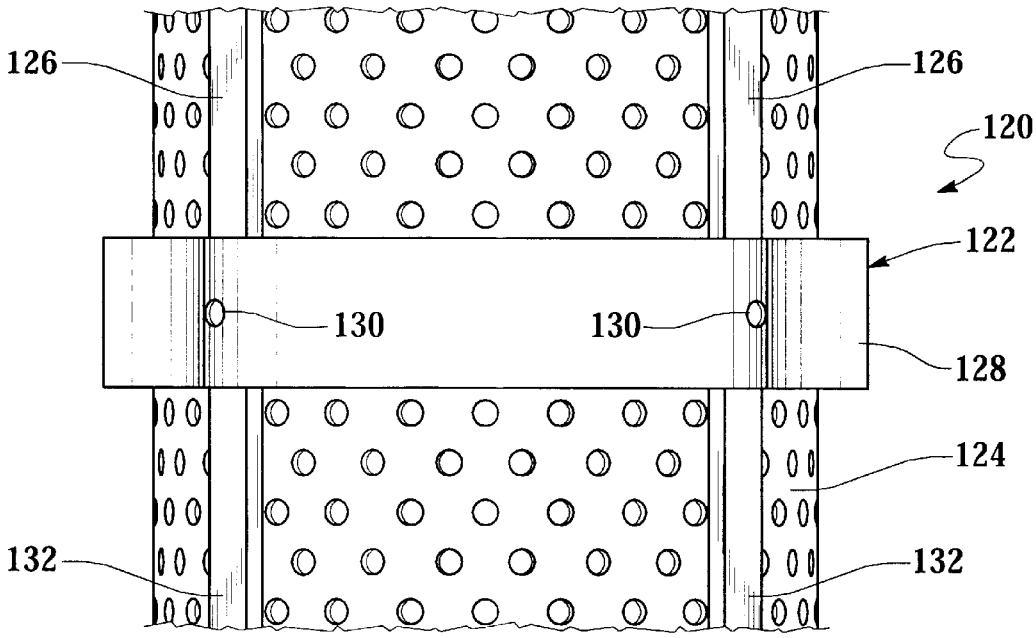
FIG. 4 is a side view of two adjacent sections of tubes meeting at a manifold of an apparatus for gravel packing an interval of a wellbore of the present invention.

Referring now to FIG. 4, therein is depicted an alternate embodiment of a manifold for the apparatus for gravel packing an interval of a wellbore that is generally designated 120. Apparatus 120 includes a tube and manifold system 122 and a sand control screen assembly 124. Tube and manifold system 122 includes four tubes 126, only two of which are pictured, that deliver the fluid slurry to manifold 128. A portion of the fluid slurry in manifold 128 will enter the annular interval surrounding apparatus 120 via four exit ports 130, only two of which are shown. The remainder of the fluid slurry enters four tubes 132, only two of which are pictured, and is delivered to the next manifold of tube and manifold system 122. This process continues along the entire length of the interval to be gravel packed such that a complete gravel pack of the interval can be achieved. In this embodiment, exit ports 130 of manifold 128 are circumferentially aligned with or are in phase with the adjacent tubes 126, 132 that deliver the fluid slurry to and transport the fluid slurry from manifold 128.

Figure 5:
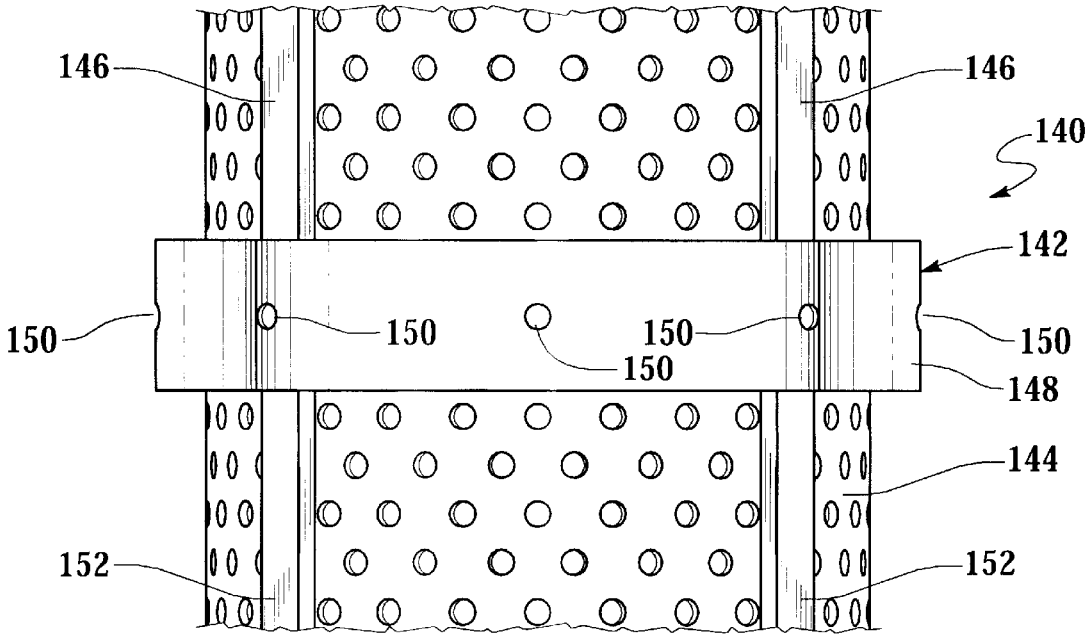
FIG. 5 is a side view of two adjacent sections of tubes meeting at a manifold of an apparatus for gravel packing an interval of a wellbore of the present invention.

Referring now to FIG. 5, therein is depicted an alternate embodiment of a manifold for the apparatus for gravel packing an interval of a wellbore that is generally designated 140. Apparatus 140 includes a tube and manifold system 142 and a sand control screen assembly 144. Tube and manifold system 142 includes four tubes 146, only two of which are pictured, that deliver the fluid slurry to manifold 148. A portion of the fluid slurry in manifold 148 will enter the annular interval surrounding apparatus 140 via eight exit ports 150, only five of which is shown. The remainder of the fluid slurry enters four tubes 152, only two of which are pictured, and is delivered to the next manifold of tube and manifold system 142. This process continues along the entire length of the interval to be gravel packed such that a complete gravel pack of the interval can be achieved. In this embodiment, there are more exit ports 150 in manifold 148 than there are tubes 146, 152, respectively delivering the fluid slurry to and carrying the fluid slurry from manifold 148. In addition, some of the exit ports are circumferentially aligned with or are in phase with the adjacent tubes 146, 152 and some of the exit ports 150 are circumferentially misaligned with or are out of phase with the adjacent tubes 146, 152.

Figure 6:
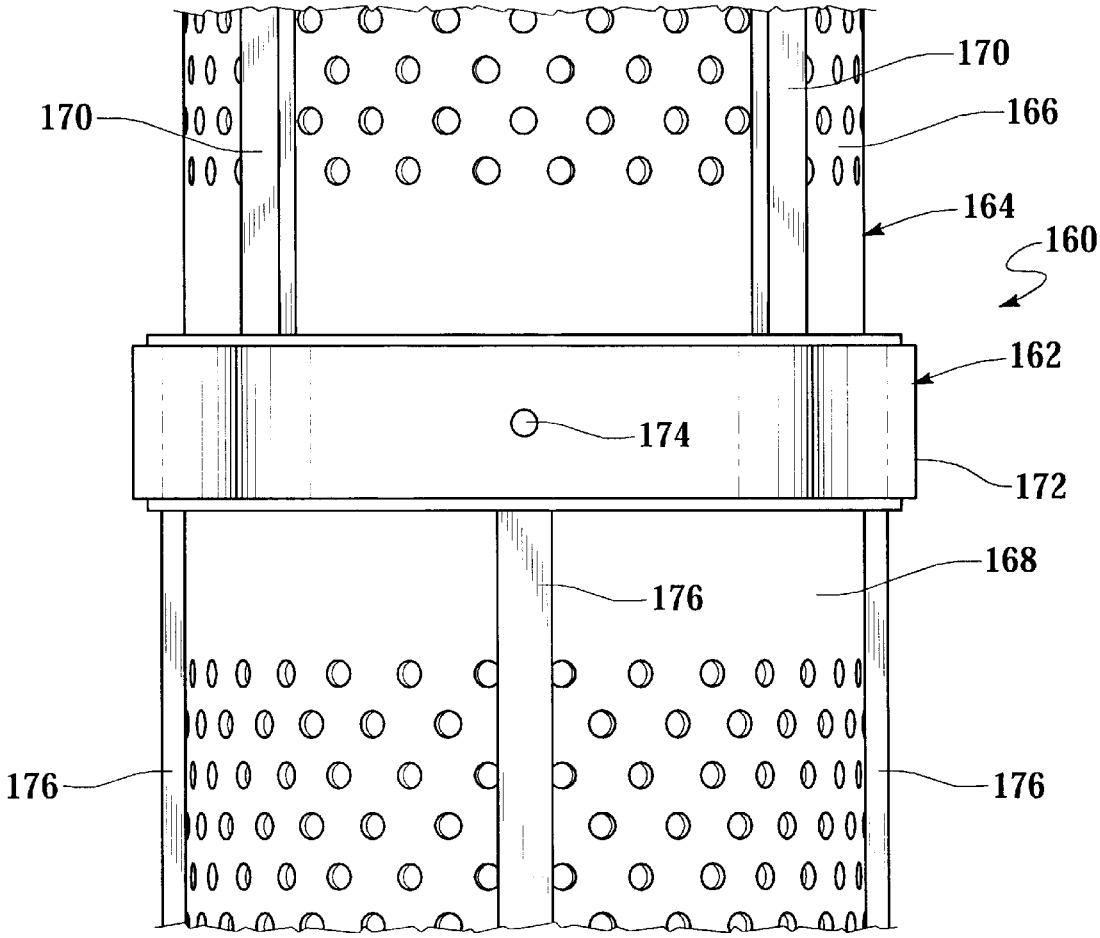
FIG. 6 is a side view of two adjacent sections of tubes meeting at a manifold of an apparatus for gravel packing an interval of a wellbore of the present invention.

Referring now to FIG. 6, therein is depicted an apparatus for gravel packing an interval of a wellbore at the point where sections of the sand control screen assembly are joined together, that is generally designated 160. Apparatus 160 includes a tube and manifold system 162 and a sand control screen assembly 164 having sections 166, 168 that are coupled together in a known manner such as via a threaded coupling. Tube and manifold system 162 includes four tubes 170, only two of which are pictured, that deliver the fluid slurry to manifold 172. A portion of the fluid slurry in manifold 172 will enter the annular interval surrounding apparatus 160 via two exit ports 174, only one of which is shown. The remainder of the fluid slurry enters four tubes 176, only three of which are pictured, and is delivered to the next manifold of tube and manifold system 162. This process continues along the entire length of the interval to be gravel packed such that a complete gravel pack of the interval can be achieved. As illustrated, tubes 170 that deliver the fluid slurry to manifold 172 are not axially aligned with tubes 176 that transport the fluid slurry from manifold 172. Unlike the manifolds pictured in FIGS. 2–5 that are positioned within the length of a single section of the sand control screen assembly and wherein the tubes adjacent to each manifold are axially aligned with one another, tubes 170, 176 that are adjacent to a manifold between two sections of the sand control screen such as manifold 172 will likely not be axially aligned. If the tube and manifold system is preassembled on each section of the sand control screen prior to coupling the sections of the sand control screen assembly into a string, the adjoining sections of the tube and manifold system at the ends of each section of the sand control screen assembly are coupled when the sections of the screen assembly are threaded together. Accordingly, it is likely that the tubes on either side of this manifold will not be axially aligned with one another.

As should become apparent to those skilled in the art, even though FIG. 6 depicts tubes 170 and tubes 176 at a forty-five-degree circumferential phase shift relative to one another, any circumferential phase shift is acceptable using the present invention as the relative circumferential positions of adjoining sections of the tube and manifold system of the present invention does not affect the operation of the present invention. As such, the mating of adjoining sections of the apparatus for gravel packing an interval of a wellbore of the present invention is substantially similar to mating typical joints of pipe to form a pipe string requiring no special coupling tools or techniques. As such, even if the tubes adjacent to a manifold are not axially aligned with one another, they are nonetheless in fluid communication with one another such that the fluid slurry may travel from one level of tubes to the next level of tubes as the manifolds provide a substantially annular region through which the fluid slurry travels allowing for such misalignment.

Figure 7:
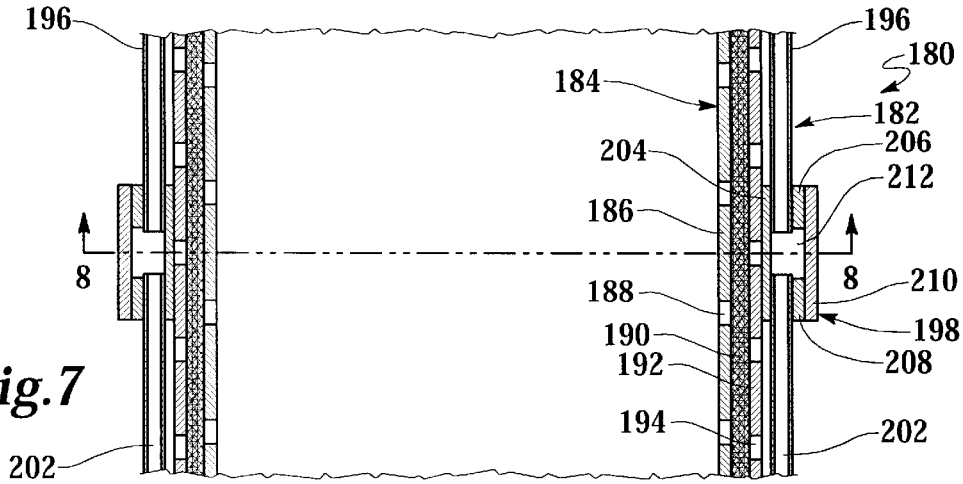
FIG. 7 is a cross sectional view of two adjacent sections of tubes meeting at a manifold of an apparatus for gravel packing an interval of a wellbore of the present invention.
Figure 8:
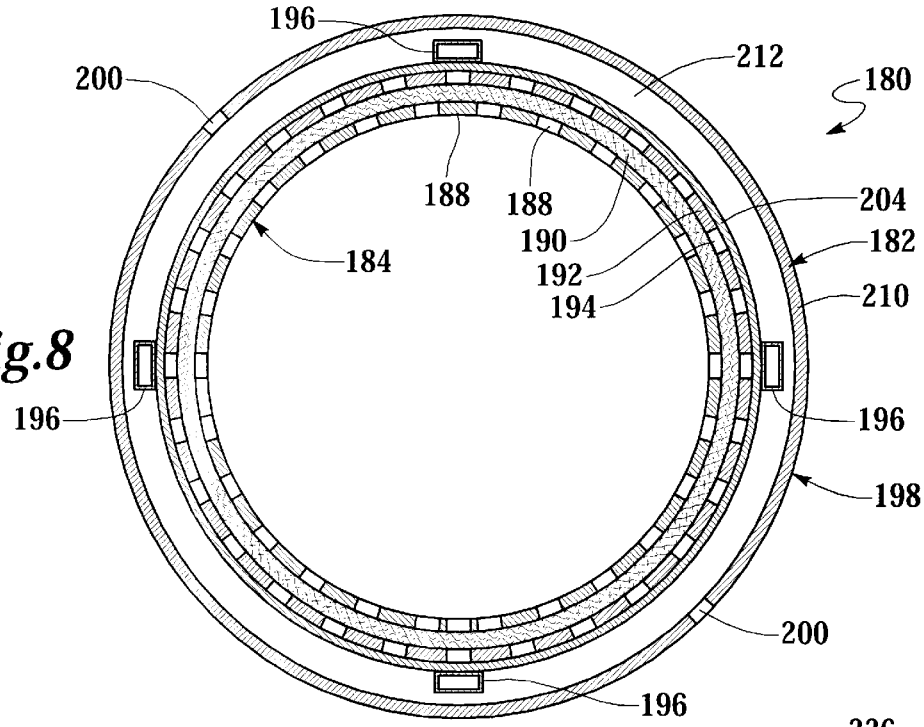
FIG. 8 is a cross sectional view of an apparatus for gravel packing an interval of a wellbore of the present invention positioned taken along line 8—8 of FIG. 7.

Referring now to FIGS. 7 and 8, therein are depicted cross sectional views of an apparatus for gravel packing an interval of a wellbore that is generally designated 180. Apparatus 180 includes a tube and manifold system 182 and a sand control screen assembly 184. In the illustrated embodiment, sand control screen assembly 184 includes base pipe 186 that has a plurality of openings 188, porous sintered wire mesh screen 190 and screen housing 192 that has a plurality of openings 194. Tube and manifold system 182 includes four tubes 196 that deliver the fluid slurry to manifold 198. A portion of the fluid slurry in manifold 198 will enter the annular interval surrounding apparatus 180 via two exit ports 200 which are not aligned with any of the tubes 196. The remainder of the fluid slurry enters four tubes 202, only two of which are pictured in FIG. 7, and is delivered to the next manifold of tube and manifold system 182.

As illustrated, manifold 198 has an inner sleeve 204 that seals against screen housing 192 such that the fluid slurry passing through manifold 198 does not enter sand control screen assembly 184 through perforations 194. Manifold 198 also includes a pair of retainer members 206, 208. Retainer member 206 and inner sleeve 204 receive and provide a seal with the discharge ends of tubes 196. Retainer member 208 and inner sleeve 204 receive and provide a seal with the receptor ends of tubes 202. Manifold 198 has an outer housing 210 that includes exit ports 200. An annular region 212 is formed between outer housing 210 and inner sleeve 204 that provides fluid communication between tubes 196 and tubes 202.

Figure 9:
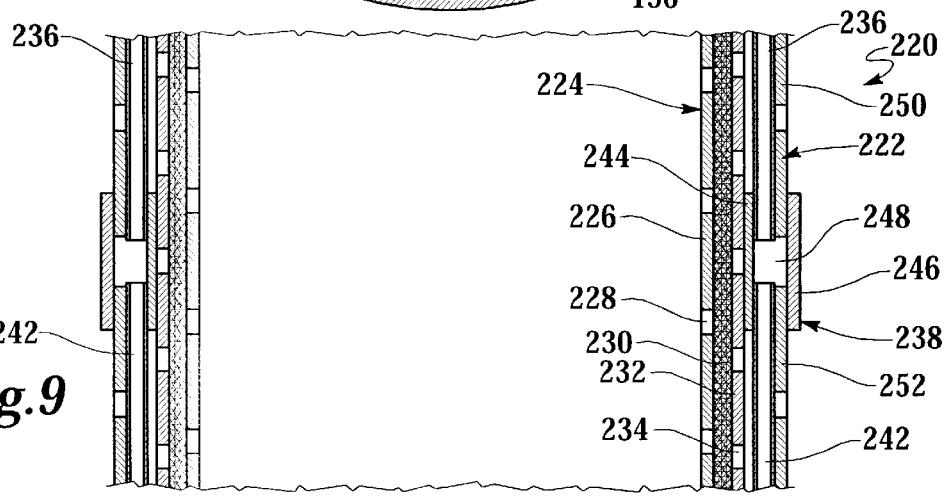
FIG. 9 is a cross sectional view two adjacent sections of tubes meeting at a manifold of an apparatus for gravel packing an interval of a wellbore of the present invention.

Referring now to FIG. 9, therein is depicted a cross sectional view of an apparatus for gravel packing an interval of a wellbore showing adjacent tubes on either side of a manifold that is generally designated 220. Apparatus 220 includes a tube and manifold system 222 and a sand control screen assembly 224. In the illustrated embodiment, sand control screen assembly 224 includes base pipe 226 that has a plurality of openings 228, porous sintered wire mesh screen 230 and screen housing 232 that has a plurality of openings 234. Tube and manifold system 222 includes four tubes 236, only two of which are visible, that deliver the fluid slurry to manifold 238. A portion of the fluid slurry in manifold 238 will enter the annular interval surrounding apparatus 220 via exit ports (not pictured) which are not aligned with any of the tubes 236. The remainder of the fluid slurry enters four tubes 242, only two of which are pictured, and is delivered to the next manifold of tube and manifold system 222.

As illustrated, manifold 238 has an inner sleeve 244 that seals against screen housing 232 such that the fluid slurry passing through manifold 238 does not enter sand control screen assembly 224 through perforations 228. Manifold 238 has an outer housing 246 that includes exit ports (not pictured). An annular region 248 is formed between outer housing 246 and inner sleeve 204 providing fluid communication between tubes 236 and tubes 242. Partially disposed within outer housing 246 of manifold 238 is a pair of perforated outer shrouds 250, 252. Outer shroud 250 protects tubes 236 and, along with inner sleeve 244, retains and provides a seal with the discharge ends of tubes 196. Likewise, outer shroud 252 protects tubes 242 and, along with inner sleeve 244, retains and provides a seal with the receptor ends of tubes 242.

Even though FIGS. 2–9 have depicted the tube and manifold system of the apparatus for gravel packing an interval of a wellbore of the present invention as having four tubes at each tube level, it should be understood by those skilled in the art that a variety of configurations of the apparatus for gravel packing an interval of a wellbore of the present invention having different numbers of tubes, either more tubes or fewer tubes are possible and is considered within the scope of the present invention. In fact, it is likely and may even be preferable to use different configurations of the tube and manifold system of the apparatus for gravel packing an interval of a wellbore of the present within a single interval.

Specifically, it may be desirable to have a volumetric capacity within the tube and manifold system that is greater toward the near end, the top in a vertical well or heel in an inclined or horizontal well, than toward the far end, the bottom or toe, of the interval. This may be achieved by using a tube and manifold system having more tubes proximate the near end of the interval and fewer tubes proximate the far end of the interval. Likewise, it may be desirable to have different numbers of exit ports on different manifolds within a tube and manifold system installed within a single interval. Specifically, it may be desirable to have fewer exit ports toward the near end of the interval compared to the far end of the interval.

Figure 10:
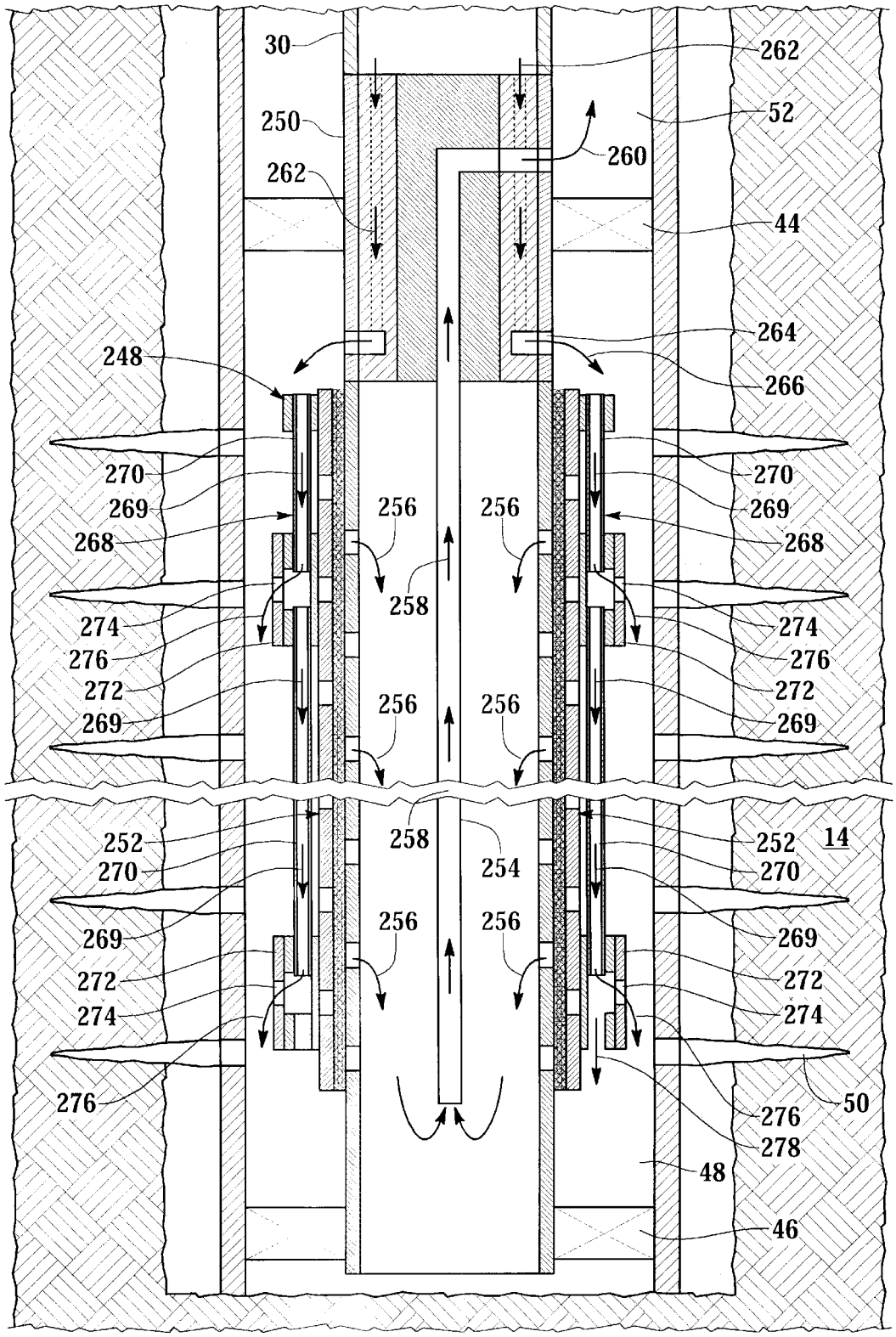
FIG. 10 is a half sectional view depicting the operation of an apparatus for gravel packing an interval of a wellbore of the present invention.

Referring now to FIG. 10, a typical completion process using an apparatus 248 for gravel packing an interval of a wellbore of the present invention will be described. First, interval 48 adjacent to formation 14 is isolated. Packer 44 seals the upper end of annular interval 48 and packer 46 seals the lower end of annular interval 48. Cross-over assembly 250 is located adjacent to screen assembly 252, traversing packer 44 with portions of cross-over assembly 250 on either side of packer 44. When the gravel packing operation commences, the objective is to uniformly and completely fill interval 48 with gravel. To help achieve this result, wash pipe 254 is disposed within screen assembly 252. Wash pipe 254 extends into cross-over assembly 250 such that return fluid passing through screen assembly 252, indicated by arrows 256, may travel through wash pipe 254, as indicated by arrow 258, and into annulus 52, as indicted by arrow 260, for return to the surface.

The fluid slurry containing gravel is pumped down work string 30 into cross-over assembly 250 along the path indicated by arrows 262. The fluid slurry containing gravel exits cross-over assembly 250 through cross-over ports 264 and is discharged into annular interval 48 as indicated by arrows 266. This is the primary path as the fluid slurry seeks the path of least resistance. Under ideal conditions, the fluid slurry travels throughout the entire interval 48 until interval 48 is completely packed with gravel. If, however, a sand bridge forms in annular interval 48 before the gravel packing operation is complete, the fluid slurry containing gravel will enter tube and manifold system 268 to bypass the sand bridge as indicated by arrows 269. As tubes 270 of tube and manifold system 268 do not have openings in their side walls, the entire volume of fluid slurry entering each tube 270 exits that tube 270 into one of the manifolds 272. Some of the fluid slurry exits each of the manifolds 272 through exit ports 274, as indicated by arrows 276. Some of the fluid slurry may also exit tube and manifold system 268 through an opening in the bottom of the last manifold, as indicated by arrow 278.

As the fluid slurry containing gravel enters annular interval 48, the gravel drops out of the slurry and builds up from formation 14, filling perforations 50 and annular interval 48 around screen assembly 252 forming the gravel pack. Some of the carrier fluid in the slurry may leak off through perforations 50 into formation 14 while the remainder of the carrier fluid passes through screen assembly 252, as indicated by arrows 256, that is sized to prevent gravel from flowing therethrough. The fluid flowing back through screen assembly 252, as explained above, follows the paths indicated by arrows 258, 260 back to the surface.

In operation, the apparatus for gravel packing an interval of a wellbore of the present invention is used to distribute the fluid slurry to various locations within the interval to be gravel packed by injecting the fluid slurry into the tube and manifold system when sand bridge formation occurs. The fluid slurry exits through the various exit ports in the manifolds along the length of the tube and manifold system into the annulus between the apparatus and the wellbore which may be cased or uncased. Once in this annulus, a portion of the gravel in the fluid slurry is deposited around the apparatus in the annulus such that the gravel migrates both circumferentially and axially from the exit ports. This process progresses along the entire length of the apparatus such that the annular area becomes completely packed with the gravel. Once the annulus is completely packed with gravel, the gravel pack operation may cease.

Alternatively, it should be noted by those skilled in the art that instead of first injecting the fluid slurry directly into annular interval 48 until a sand bridge forms, the fluid slurry may initially be injected directly into the apparatus for gravel packing an interval of a wellbore of the present invention. In either embodiment, once the gravel pack is completed and the well is brought on line, formation fluids that are produced into the gravel packed interval must travel through the gravel pack in the annulus prior to entering the sand control screen assembly. As such, the apparatus for gravel packing an interval of a wellbore of the present invention allows for a complete gravel pack of an interval so that particulate materials in the formation fluid are filtered out.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An apparatus for gravel packing an interval of a wellbore, the apparatus comprising:

a sand control screen positioned within the wellbore; and a tube and manifold system positioned between the sand control screen and the wellbore, the tube and manifold system delivers a fluid slurry to a plurality of levels of the interval when the apparatus is in an operable position, the tubes of the tube and manifold system having first and second ends, the tubes being open only at the first and second ends, the manifolds of the tube and manifold system having at least one exit port for the discharge of the fluid slurry from the tube and manifold system.

2. The apparatus as recited in claim 1 wherein one tube extends between each of the manifolds of the tube and manifold system.

3. The apparatus as recited in claim 1 wherein a plurality of tubes extend between each of the manifolds of the tube and manifold system.

4. The apparatus as recited in claim 1 wherein the exit ports of the manifolds are not circumferentially aligned with adjacent tubes of the tube and manifold system.

5. The apparatus as recited in claim 1 wherein the exit ports of the manifolds are circumferentially aligned with adjacent tubes of the tube and manifold system.

6. The apparatus as recited in claim 1 wherein the number of exit ports in each manifold is less than the number of tubes delivering the fluid slurry to that manifold.

7. The apparatus as recited in claim 1 wherein the number of exit ports in each manifold is the same as the number of tubes delivering the fluid slurry to that manifold.

8. The apparatus as recited in 1 wherein the number of exit ports in each manifold is greater than the number of tubes delivering the fluid slurry to that manifold.

9. The apparatus as recited in claim 1 wherein the sand control screen further comprises a plurality of sections, wherein each section of the sand control screen has a plurality of the manifolds positioned adjacent thereto and wherein one of the manifolds is positioned between each adjacent section of the sand control screen.

10. The apparatus as recited in claim 9 wherein the tubes on either side of the manifolds positioned adjacent to the sections of the sand control screen are axially aligned.

11. The apparatus as recited in claim 9 wherein the tubes on either side of the manifolds positioned between adjacent sections of the sand control screen are not axially aligned.

12. An apparatus for gravel packing an interval of a wellbore, the apparatus comprising:

a sand control screen positioned within the wellbore; and a tube and manifold system positioned between the sand control screen and the wellbore, the tube and manifold system delivers a fluid slurry to a plurality of levels of the interval when the apparatus is in an operable position, the tubes of the tube and manifold system having first and second ends, the tubes being open only at the first and second ends, the manifolds of the tube and manifold system having at least one exit port for the discharge of the fluid slurry from the tube and manifold system, the exit ports of the manifolds are not circumferentially aligned with adjacent tubes of the tube and manifold system.

13. The apparatus as recited in claim 12 wherein one tube extends between each of the manifolds of the tube and manifold system.

14. The apparatus as recited in claim 12 wherein a plurality of tubes extend between each of the manifolds of the tube and manifold system.

15. The apparatus as recited in claim 12 wherein the number of exit ports in each manifold is less than the number of tubes delivering the fluid slurry to that manifold.

16. The apparatus as recited in claim 12 wherein the number of exit ports in each manifold is the same as the number of tubes delivering the fluid slurry to that manifold.

17. The apparatus as recited in 12 wherein the number of exit ports in each manifold is greater than the number of tubes delivering the fluid slurry to that manifold.

18. The apparatus as recited in claim 12 wherein the sand control screen further comprises a plurality of sections, wherein each section of the sand control screen has a plurality of the manifolds positioned adjacent thereto and wherein one of the manifolds is positioned between each adjacent section of the sand control screen.

19. The apparatus as recited in claim 18 wherein the tubes on either side of the manifolds positioned adjacent to the sections of the sand control screen are axially aligned.

20. The apparatus as recited in claim 18 wherein the tubes on either side of the manifolds positioned between adjacent sections of the sand control screen are not axially aligned.

21. An apparatus for gravel packing an interval of a wellbore, the apparatus comprising:

a sand control screen having a plurality of sections, the sand control screen positioned within the wellbore; and a tube and manifold system positioned between the sand control screen and the wellbore, the tube and manifold system delivers a fluid slurry to a plurality of levels of the interval when the apparatus is in an operable position, the tubes of the tube and manifold system having first and second ends, the tubes being open only at the first and second ends, the manifolds of the tube and manifold system having at least one exit port for the discharge of the fluid slurry from the tube and manifold system, the exit ports of the manifolds are not circumferentially aligned with adjacent tubes of the tube and manifold system, each section of the sand control screen having a plurality of manifolds positioned adjacent thereto and each adjacent section of the sand control screen having one of the manifolds positioned therebetween.

22. The apparatus as recited in claim 21 wherein one tube extends between each of the manifolds of the tube and manifold system.

23. The apparatus as recited in claim 21 wherein a plurality of tubes extend between each of the manifolds of the tube and manifold system.

24. The apparatus as recited in claim 21 wherein the number of exit ports in each manifold is less than the number of tubes delivering the fluid slurry to that manifold.

25. The apparatus as recited in claim 21 wherein the number of exit ports in each manifold is the same as the number of tubes delivering the fluid slurry to that manifold.

26. The apparatus as recited in 21 wherein the number of exit ports in each manifold is greater than the number of tubes delivering the fluid slurry to that manifold.

27. The apparatus as recited in claim 21 wherein the tubes on either side of the manifolds positioned within the sections of the sand control screen are axially aligned.

28. The apparatus as recited in claim 21 wherein the tubes on either side of the manifolds positioned between adjacent sections of the sand control screen are not axially aligned.

29. A method for gravel packing an interval of a wellbore, the method comprising the steps of:

traversing a formation with the wellbore;

positioning a tube and manifold system within the wellbore proximate the formation, the tubes of the tube and manifold system having first and second ends, the tubes having openings only at the first and second ends, the manifolds of the tube and manifold system having at least one exit port;

locating a sand control screen within the tube and manifold system;

injecting a fluid slurry containing gravel through the tube and manifold system such that the fluid slurry exits the tube and manifold system through the exit ports in the manifolds at a plurality of levels of the interval; and terminating the injecting when the interval is substantially completely packed with the gravel.

30. The method as recited in claim 29 wherein the step of injecting a fluid slurry containing gravel through the tube and manifold system further comprises injecting the fluid slurry containing gravel through a single tube extending between each of the manifolds of the tube and manifold system.

31. The method as recited in claim 29 wherein the step of injecting a fluid slurry containing gravel through the tube and manifold system further comprises injecting the fluid slurry containing gravel through a plurality of tubes extending between each of the manifolds of the tube and manifold system.

32. The method as recited in claim 29 further comprising the step of circumferentially misaligning the exit ports of the manifolds with adjacent tubes of the tube and manifold system.

33. The method as recited in claim 29 further comprising the step of circumferentially aligning the exit ports of the manifolds with adjacent tubes of the tube and manifold system.

34. The method as recited in claim 29 further comprising the step of positioning a plurality of manifolds adjacent to each section of the sand control screen and positioning one of the manifolds between adjacent sections of the sand control screen.

35. The method as recited in claim 34 further comprising the step of axially aligning the tubes on either side of the manifolds positioned adjacent to the sections of the sand control screen.

36. The method as recited in claim 34 further comprising the step of axially misaligning the tubes on either side of the manifolds positioned between adjacent sections of the sand control screen.

37. A method for gravel packing an interval of a wellbore, the method comprising the steps of:

traversing a formation with the wellbore;

positioning a tube and manifold system around a sand control screen, the tubes of the tube and manifold system having first and second ends, the tubes having openings only at the first and second ends, the manifolds of the tube and manifold system having at least one exit port;

locating the sand control screen and the tube and manifold system within the wellbore proximate the formation;

injecting a fluid slurry containing gravel through the tube and manifold system such that the fluid slurry exits the tube and manifold system through the exit ports in the manifolds at a plurality of levels of the interval; and terminating the injecting when the interval is substantially completely packed with the gravel.

38. The method as recited in claim 37 wherein the step of injecting a fluid slurry containing gravel through the tube and manifold system further comprises injecting the fluid slurry containing gravel through a single tube extending between each of the manifolds of the tube and manifold system.

39. The method as recited in claim 37 wherein the step of injecting a fluid slurry containing gravel through the tube and manifold system further comprises injecting the fluid slurry containing gravel through a plurality of tubes extending between each of the manifolds of the tube and manifold system.

40. The method as recited in claim 37 further comprising the step of circumferentially misaligning the exit ports of the manifolds with adjacent tubes of the tube and manifold system.

41. The method as recited in claim 37 further comprising the step of circumferentially aligning the exit ports of the manifolds with adjacent tubes of the tube and manifold system.

42. The method as recited in claim 37 further comprising the step of positioning a plurality of manifolds adjacent to each section of the sand control screen and positioning one of the manifolds between adjacent sections of the sand control screen.

43. The method as recited in claim 42 further comprising the step of axially aligning the tubes on either side of the manifolds positioned adjacent to the sections of the sand control screen.

44. The method as recited in claim 42 further comprising the step of axially misaligning the tubes on either side of the manifolds positioned between adjacent sections of the sand control screen.

45. A method for gravel packing an interval of a wellbore, the method comprising the steps of:

traversing a formation with the wellbore;

positioning a tube and manifold system around a sand control screen having a plurality of sections, the tubes of the tube and manifold system having first and second ends, the tubes having openings only at the first and second ends, the manifolds of the tube and manifold system having at least one exit port;

positioning a plurality of manifolds adjacent to each section of the sand control screen and positioning one of the manifolds between adjacent sections of the sand control screen;

circumferentially misaligning the exit ports of the manifolds with adjacent tubes of the tube and manifold system;

locating the sand control screen and the tube and manifold system within the wellbore proximate the formation;

injecting a fluid slurry containing gravel through the tube and manifold system such that the fluid slurry exits the tube and manifold system through the exit ports in the manifolds at a plurality of levels of the interval; and terminating the injecting when the interval is substantially completely packed with the gravel.

46. The method as recited in claim 45 wherein the step of injecting a fluid slurry containing gravel through the tube and manifold system further comprises injecting the fluid slurry containing gravel through a single tube extending between each of the manifolds of the tube and manifold system.

47. The method as recited in claim 45 wherein the step of injecting a fluid slurry containing gravel through the tube and manifold system further comprises injecting the fluid slurry containing gravel through a plurality of tubes extending between each of the manifolds of the tube and manifold system.

48. The method as recited in claim 45 further comprising the step of axially aligning the tubes on either side of the manifolds positioned adjacent to the sections of the sand control screen.

49. The method as recited in claim 45 further comprising the step of axially misaligning the tubes on either side of the manifolds positioned between adjacent sections of the sand control screen.

* * * * *